United States Patent [19]

Matsumoto et al.

[11] 3,939,089

[45] Feb. 17, 1976

[54] ETCHING SOLUTIONS FOR COPPER AND COPPER ALLOYS AND ETCHING PROCESS USING THE SAME

[75] Inventors: Akira Matsumoto; Katsutoshi Itani, both of Fuji, Japan

[73] Assignee: Tokai Denka Kogyo Kabushiki Kaisha, Tokyo, Japan

[22] Filed: Sept. 30, 1974

[21] Appl. No.: 510,536

[30] Foreign Application Priority Data

Oct. 17, 1973 Japan ..... 48-115711

[52] U.S. Cl. ..... 252/79.4; 156/18

[51] Int. Cl.[2] ..... C09K 13/06; C23F 1/00

[58] Field of Search ..... 252/79.4; 156/18; 134/3, 134/41

[56] References Cited

UNITED STATES PATENTS

| | | | |
|---|---|---|---|
| 3,216,873 | 11/1965 | Jones | 156/14 |
| 3,410,802 | 11/1968 | Radimer et al. | 252/79.1 |
| 3,770,530 | 11/1973 | Fujimoto | 252/79.4 X |

*Primary Examiner*—William A. Powell

*Attorney, Agent, or Firm*—Flynn & Frishauf

[57] ABSTRACT

This invention provides etching solutions for copper and copper alloys comprising a mixed aqueous solution of a peroxysulfate with a purine compound and a halogen compound added as the catalyst. There is also provided a process for etching copper or copper alloys with said etching solutions.

9 Claims, No Drawings

ETCHING SOLUTIONS FOR COPPER AND COPPER ALLOYS AND ETCHING PROCESS USING THE SAME

BACKGROUND OF THE INVENTION

1. Field of the Invention

This invention relates to etching solutions for copper and copper alloys and an etching process using said etching solutions. More particularly it is concerned with aqueous peroxysulfate solutions for the etching of copper and copper alloys containing catalysts for greatly increasing the rate of etching.

2. Description of the Prior Art

Etching of copper and copper alloys has been acquiring increasing importance in a variety of industrial fields. Particularly with development of the electronic industry, etching has become very important in the production of printed circuit plates and lead frames of the IC circuit. Heretofore, the etching of copper and copper alloys has usually been done with ferric chloride, peroxysulfates. chromicsulfonic acid mixtures and the like. However, ferric chloride, which dissolves solder, cannot be used for the solder-plated materials and is therefore unsuitable for the production of high-grade printed circuit boards. Chromic-sulfuric acid mixtures are also unsuitable for industrial use in view of associated pollution problems. Waste from the acid mixtures contains chromium which is difficult to be removed. Under such circumstance peroxysulfates are commonly employed for etching. As the rate of etching copper and copper alloys is very slow with a peroxysulfate alone, mercury salts are usually added in order to induce a faster rate of the etching as described in Japanese Patent Publication 16,008/1961. Although the amount of the mercury salt used is small, it should be removed in order to avoid pollution problems when discharged into a river as waste. However, complete removal of mercury is very difficult. Therefore substitute catalysts are eagerly desired.

An attempt to develop catalysts other than the mercury salts is illustrated in Japanese Pat. Publication No. 33185/1962 in which thiourea, ethylenethiourea, hexamethylenetetramine and the like are reported to be effective.

The catalytic effect of these catalysts, however, is of short duration. It is necessary that they be supplemented frequently. Thus, they are not economically satisfactory despite their promoting effects on the rate of etching.

SUMMARY OF THE INVENTION

It is an object of the present invention to provide aqueous peroxysulfate solutions for etching copper and copper alloys with which the etching is accelerated for a long period of time and at the same time overcomes the above-mentioned difficulties.

After extensive investigations of the process for etching copper and copper alloys with an aqueous peroxysulfate solution we have found that addition of one or more purine compounds and one or more halogen compounds as the catalyst to an aqueous peroxysulfate solution greatly increases the etching rate as well as duration of the etching effect.

DESCRIPTION OF THE INVENTION

This invention is based upon the unique action exerted in the coexistence of a purine compound and a halogen compound. The object of the invention will not be realized in the singular presence of either one of the purine and halogen compounds.

As the purine compound suitable for use in the invention are mentioned compounds containing a purine ring

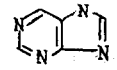

such as, purine, adenine, chloropurines, purinethiols, guanine, xanthine, hypoxanthine, theophylline and the like.

As the halogen compound substances are used which liberate halogen in an aqueous peroxysulfate solution, which include, for example, hydrofluoric acid and salts thereof, hydrochloric acid and salts thereof, hydrobromic acid and salts thereof, hydroiodic acid and salts thereof, oxides of fluorine, chlorine, bromine and iodine, oxygen-containing acids of chlorine, bromine and iodine and salts thereof, dichloroisocyanuric acid and salts thereof, 1-chlorodiethylether and the like. From the economical point of view, hydrochloric acid and salts thereof are preferred. As the peroxysulfate ammonium, potassium, sodium and lithium salts of peroxymonosulfuric acid and ammonium, potassium, sodium and barium salts of peroxydisulfuric acid and the like as described in Japanese Pat. Publications No. 9463/1964 and 11324/1966 are used. Ammonium peroxymonosulfate and peroxydisulfate are preferable for the invention.

Copper and copper alloys to which the invention can be applied include copper, brass, bronze, beryllium copper, constantan and the like.

Concentration of the peroxysulfate in etching copper and copper alloys according to the invention is from 5% by weight to the solubility limit and preferably from 5% by weight to 25% by weight, and that of the purine compound is from 10 p.p.m. to the solubility limit and preferably from 50 p.p.m. to 1000 p.p.m. Whereas addition of these compounds in concentrations in excess of 1,000 p.p.m. will not produce adverse reactions it is not economical. Concentration of the halogen compound is from 5 p.p.m. to 1000 p.p.m. and preferably from 10 p.p.m. to 500 p.p.m. The concentrations in excess of 1,000 p.p.m. will have a deterious effect upon the result of the invention.

DESCRIPTION OF PREFERRED EMBODIMENTS

The invention is illustrated by the following examples:

EXAMPLES 1 – 12

Etching solutions were prepared at concentrations of 250 g./l. of ammonium peroxydisulfate and 50 ml/l. of 75% by weight orthophosphoric acid with a purine compound alone or in combination with sodium chloride. The etching solution was placed in a small plate-rotary spray etcher, which was then used for etching the copper off a copper laminated board 5cm. × 5cm. in size with copper foil thickness 35 $\mu$ at a spray pressure of 0.5 kg./cm.$^2$ while maintaining the temperature at 40°C. Results are shown in Table I.

Table I

| Example No. | Name and concentration of purine compound | Concentration mg./l. | Concentration of sodium chloride p.p.m.($Cl^-$) | Rate of etching μ/min. Initially | After 8 hrs. |
|---|---|---|---|---|---|
| 1 | Purine | 80 | — | 6.7 | |
| 2 | " | " | 10 | 60.0 | 53.8 |
| 3 | Adenine | 200 | — | 8.6 | |
| 4 | " | 400 | — | 11.5 | |
| 5 | " | " | 10 | 41.1 | 34.0 |
| 6 | 6-Mercaptopurine (Purinethiol) | 100 | — | 8.1 | |
| 7 | " | " | 10 | 47.9 | 43.8 |
| 8 | 6-Chloropurine | 100 | — | 40.4 | 38.2 |
| 9 | Hypoxanthine | " | — | 5.3 | |
| 10 | " | " | 10 | 24.3 | 20.3 |
| 11 | Guanine | 200 | — | 9.4 | |
| 12 | " | " | 10 | 20.8 | 19.8 |
| Comparative Example (1) | — | — | — | 5.0 | 3.0 |
| Example (2) | — | — | 10 | 2.7 | 2.0 |
| Example (3) | Thiourea | 500 p.p.m. | — | 23.0 | 3.0 |

The data in Table I indicates that the etching of copper is increased in rate and duration in effect only by the coexistence of a purine and a halogen compound.

EXAMPLES 13 – 19

Etching solutions were prepared of 250 g./l. of ammonium peroxydisulfate, 50 ml./l. of 75% by weight orthophosphoric acid and 200 mg./l. of adenine with varied concentrations of sodium chloride. Etching of copper was made in the same way as in Examples 1–12. Results are shown in Table II.

Table II

| Example No. | Sodium chloride p.p.m. (in terms of $Cl^-$) | Rate of etching μ/min. |
|---|---|---|
| 13 | 10 | 36.1 |
| 14 | 20 | 35.0 |
| 15 | 50 | 37.5 |
| 16 | 100 | " |
| 17 | 200 | " |
| 18 | 500 | " |
| 19 | 1000 | 21.2 |

The data in Table II indicate that the presence of chlorine ion at 1,000 p.p.m. or more adversely reduce the etching rate.

EXAMPLES 20 – 23

A solution was prepared at concentrations of 250 g./l. of ammonium peroxydisulfate, 50 ml./l. of 75% by weight orthophosphoric acid and 200 mg./l. of adenine, to which were added sodium bromide, potassium iodide, dichloroisocyanuric acid and 1-chlorodiethylether respectively. Etching of copper was performed using the solution in the same way as in Examples 1–12. Results are shown in Table III.

Table III

| Example No. | Name of the halogen compound | Concentration p.p.m. | Rate of etching μ/min. |
|---|---|---|---|
| 20 | Sodium bromide | 50 | 36.5 |
| 21 | Potassium iodide | 50 | 34.2 |
| 22 | Dichloroisocyanuric acid | 50 | 29.8 |
| 23 | 1-Chlorodiethylether | 50 | 36.9 |

EXAMPLE 24

A solution was prepared of ammonium peroxymonosulfate at 100 g./l., sulfuric acid at 50 g./l., purine at 200 mg./l. and sodium chloride at 10 p.p.m. in terms of chloride ion. Etching of copper was carried out using the solution in the same way as in Examples 1–12. Rate of the copper etching was 58.2 μ/min. As a comparative example, etching of copper was carried out in the same way as above using a solution containing only ammonium peroxymonosulfate at 100 g./l. and sulfuric acid at 50 g./l. The rate of the copper etching was 8.0 μ/min.

We claim:

1. An etching solution for copper and copper alloys comprising an aqueous peroxysulfate solution containing from 5 percent by weight to its solubility limit therein of a peroxysulfate, from 10 parts per million to its solubility limit therein of a purine compound, and from 5 parts per million to 1,000 parts per million of a halogen compound which liberates halogen in an aqueous peroxysulfate solution.

2. An etching solution according to claim 1 wherein the peroxysulfate is ammonium peroxymonosulfate or ammonium peroxydisulfate.

3. An etching solution according to claim 1 wherein the purine compound is a member selected from the group consisting of purine, adenine, a chloropurine, a purinethiol, guanine, xanthine, hypoxanthine and theophylline.

4. An etching solution according to claim 1 wherein the halogen compound is a member selected from the group consisting of hydrofluoric acid and salts thereof, hydrochloric acid and salts thereof, hydrobromie acid and salts thereof, hydroiodic acid and salts thereof, oxides of fluorine, chlorine, bromine and iodine, oxygen-containing acids of chlorine, bromine and iodine and salts thereof, dichloroisocyanuric acid and salts thereof and 1-chlorodiethylether.

5. An etching solution of claim 1, wherein the concentration of said peroxysulfate is from 5 to 25 percent by weight, the concentration of said purine compound is from 50 to 1,000 parts per million, and the concentration of said halogen compound is from 10 to 500 parts per million.

6. An etching solution for copper and copper alloys comprising an aqueous solution containing from 5 percent by weight to its solubility limit therein of a peroxysulfate, from 10 parts per million to its solubility limit therein of a purine compound, and from 5 parts per million to 1,000 parts per million of a halogen compound which liberates halogen in an aqueous peroxysulfate solution.

7. An etching solution of claim 6, wherein the concentration of said peroxysulfate is from 5 to 25 percent by weight, the concentration of said purine compound is from 50 to 1,000 parts per million, and the concentration of said halogen compound is from 10 to 500 parts per million.

8. In the process for etching copper and copper alloys with an aqueous peroxysulfate solution containing from 5 percent by weight to its solubility limit therein of a peroxysulfate, which comprises adding to said solution from 10 parts per million to its solubility limit therein of a purine compound, and from 5 parts per million to 1,000 parts per million of a halogen compound which liberates halogen in an aqueous peroxysulfate solution.

9. The process of claim 8, wherein the concentration of said peroxysulfate is from 5 to 25 percent by weight, the concentration of said purine compound is from 50 to 1,000 parts per million, and the concentration of said halogen compound is from 10 to 500 parts per million.

* * * * *